US005682011A

United States Patent [19]

Sabranski et al.

[11] Patent Number: 5,682,011

[45] Date of Patent: Oct. 28, 1997

[54] SEALING RING ARRANGEMENT FOR A SPIN-STABILIZED PROJECTILE

[75] Inventors: Udo Sabranski, Lachendorf; Henning Von Seidlitz, Neuss; Ralf-Joachim Herrmann, Senzig, all of Germany

[73] Assignee: Rheinmetall Industrie Aktiengesellschaft, Ratingen, Germany

[21] Appl. No.: 708,605

[22] Filed: Sep. 5, 1996

[30] Foreign Application Priority Data

Sep. 5, 1995 [DE] Germany ..... 195 32 745.4

[51] Int. Cl.[6] ..... F42B 14/00

[52] U.S. Cl. ..... 102/527; 102/524; 102/526

[58] Field of Search ..... 102/501, 517, 102/520–527

[56] References Cited

U.S. PATENT DOCUMENTS

| | | | |
|---|---|---|---|
| 707,135 | 8/1902 | Maxim | 102/526 |
| 1,044,360 | 11/1912 | DuBois | 102/526 |
| 1,861,522 | 6/1932 | Brandt | 102/527 |
| 3,687,079 | 8/1972 | Scollins | 102/526 |
| 4,754,707 | 7/1988 | Ahlers | 102/524 |

FOREIGN PATENT DOCUMENTS

| | | | |
|---|---|---|---|
| 73977 | 11/1944 | Czechoslovakia | 102/520 |
| 114190 | 11/1899 | Germany . | |
| 217869 | 12/1967 | Sweden | 102/520 |
| 25850 | of 1912 | United Kingdom | 102/520 |
| 22286 | of 1915 | United Kingdom | 102/520 |
| 2132321 | 7/1984 | United Kingdom | 102/524 |

*Primary Examiner*—Harold J. Tudor
*Attorney, Agent, or Firm*—Spencer & Frank

[57] ABSTRACT

A spin-stabilized projectile includes a projectile body having a trailing end; a first circumferential groove provided in the projectile body; and a second circumferential groove provided in the projectile body between the first circumferential groove and the trailing end of the projectile body. A rotating band is received in the first circumferential groove and a sealing ring is received in the second circumferential groove. The scaling ring has a radial and an axial clearance of between 0.5 and 1 mm from the walls of the second groove.

11 Claims, 1 Drawing Sheet

SEALING RING ARRANGEMENT FOR A SPIN-STABILIZED PROJECTILE

BACKGROUND OF THE INVENTION

This invention relates to a spin-stabilized projectile having a rotating band (guide band) situated in a first circumferential groove provided in the projectile body and a sealing ring disposed in a second circumferential groove provided in the projectile body between the rotating band and the trailing end of the projectile.

a projectile of the above-outlined type is disclosed, for example, in German Patent No. 114,190. The rotating band and the sealing ring are situated in axially separate circumferential grooves of the projectile body; both grooves have approximately the same depth related to the upper projectile surface. The sealing ring is rotatably supported on the projectile body and follows the rifling of the weapon barrel independently of the rotation of the projectile as the projectile passes therethrough. By virtue of this arrangement a wear of the sealing ring during passage of the projectile through the weapon barrel is sought to be avoided so that a sealing of the propellant gases against leakage past the projectile is ensured.

Tests have shown, however, that the sealing effect of sealing rings of the above-outlined type is frequently not ensured for the entire passage of the projectile through the weapon barrel. Further, particularly in worn-out weapon barrels where the inner barrel diameter increases in the forward direction (muzzle wear), the sealing effect of the known sealing rings is not satisfactory. By virtue of the insufficient seal the barrel wear increases and further, the impact accuracy is reduced and in some instances the projectile body is weakened.

SUMMARY OF THE INVENTION

It is an object of the invention to provide an improved sealing ring arrangement for a spin-stabilized projectile of the above-outlined type in which a seal between the barrel and the projectile is ensured throughout the entire passage of the projectile through the weapon barrel.

This object and others to become apparent as the specification progresses, are accomplished by the invention, according to which, briefly stated, the spin-stabilized projectile includes a projectile body having a trailing end; a first circumferential groove provided in the projectile body; and a second circumferential groove provided in the projectile body between the first circumferential groove and the trailing end of the projectile body. A rotating band is received in the first circumferential groove and a sealing ring is received in the second circumferential groove. The sealing ring has a radial and an axial clearance of between 0.5 and 1 mm from the walls of the second groove.

The invention is essentially based on the principle to arrange the sealing ring in the projectile groove with a radial and an axial clearance from the groove walls. As a result of such an arrangement, during the entire passage of the projectile through the barrel, the propellant gases press the sealing ring outwardly against the barrel wall. Even if the barrel has worn parts, a leakage of propellant gases past the projectile is prevented.

According to a particularly advantageous feature of the invention, the sealing ring is a composite ring which is formed of a rigid inner ring made, for example, of steel and a plastically easily deformable outer ring made, for example, of a soft metal such as copper or a synthetic material such as nylon or PVC. During passage of the projectile through the weapon barrel, the barrel rifling bites into the soft outer ring while the inner ring maintains the clearance between the projectile and the sealing ring.

The radial stiffness of the inner ring should be preferably selected such that it resists the outer pressure upon deformation of the outer ring but yields to the gas pressure in the gap between the inner ring and the bottom of the projectile groove. As a result, the sealing ring securely seals the projectile even if the inner barrel diameter of the weapon barrel increases in the forward direction.

DESCRIPTION OF THE PREFERRED EMBODIMENTS

Figure 1:
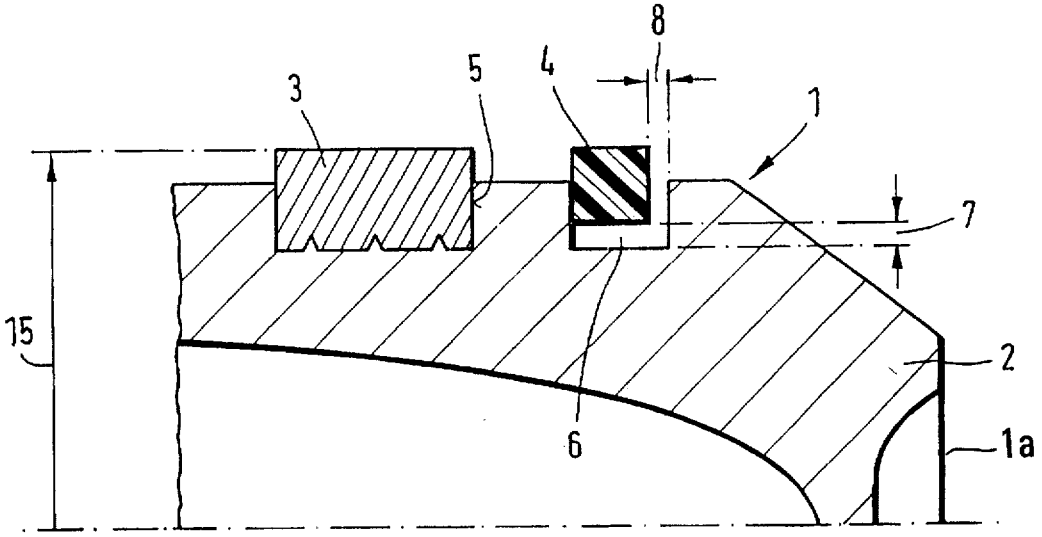
FIG. 1 is an axial sectional view of a symmetrical axial half of a trailing part of an artillery projectile incorporating a first preferred embodiment of the invention.

Turning to FIG. 1, there is illustrated a trailing part 1 of a projectile body 2 provided with axially spaced circumferential grooves 5 and 6 respectively receiving a copper rotating band 3 and a PVC sealing ring 4. The groove 6 is situated between the groove 5 and a rearward end 1*a* of the trailing part 1. While the rotating band 3 is fixedly connected with the projectile body 2 in the groove 5, the sealing ring 4 has, according to the invention, a radial clearance 7 and an axial clearance 8 from the groove walls. Both clearances have a magnitude in the range of between 0.5 and 1 mm.

Figure 2:
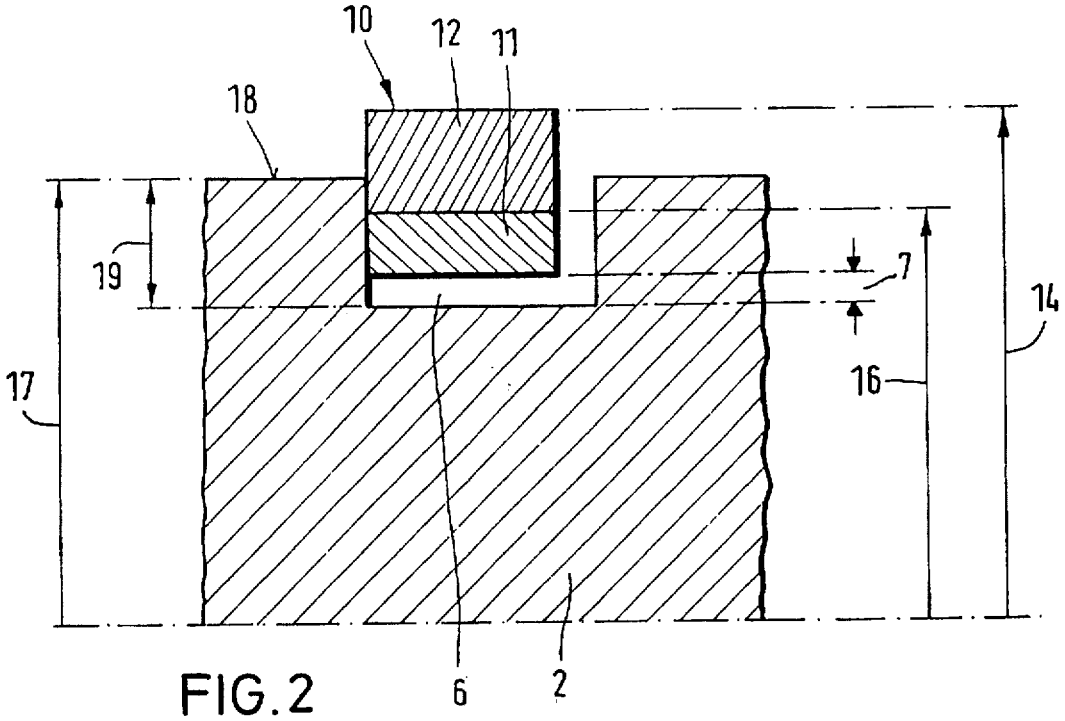
FIG. 2 is a enlarged longitudinal sectional view of a trailing part of an artillery projectile incorporating a second preferred embodiment of the invention.

The sealing ring 10 illustrated in FIG. 2 is a two-part assembly, composed of an inner ring 11 made of steel and an outer ring 12 made of a soft metal, such as copper or a synthetic material such as nylon or PVC. The radial stiffness of the inner ring 11 is selected such that it resists the external pressure generated upon deformation of the outer ring 12 as the projectile passes through the weapon barrel, but yields to the gas pressure prevailing in the clearance 7 between the inner ring 11 and the bottom of the groove 6 provided in the projectile body 2.

It has been found in practice to be advantageous for the outer diameter 14 of the outer ring 12 to be approximately the same as the outer diameter 15 of the rotating band 3 and for the outer diameter 16 of the inner ring 11 to be approximately 1 mm less than the outer diameter 17 of the projectile.

Further, both grooves 5 and 6 have the same depth 19 related to the upper surface 18 of the projectile body 2.

It will be understood that the above description of the present invention is susceptible to various modifications, changes and adaptations, and the same are intended to be comprehended within the meaning and range of equivalents of the appended claims.

What is claimed is:

1. A spin-stabilized projectile comprising (a) a projectile body having a trailing part terminating in a rearward end;

(b) a first circumferential groove provided in said trailing part;

(c) a second circumferential groove provided in said trailing part between said first circumferential groove and said rearward end; said second circumferential groove having groove walls and being axially spaced from said first circumferential groove;

(d) a rotating band received in said first circumferential groove; and (e) a sealing ring received in said second circumferential groove; said sealing ring having a radial and an axial clearance of between 0.5 and 1 mm from said groove walls.

2. The spin-stabilized projectile as defined in claim 1, wherein said projectile body has an outer surface and said first and second circumferential grooves have approximately identical depths related to said outer surface of said projectile body.

3. The spin-stabilized projectile as defined in claim 1, wherein said sealing ring is a sealing ring assembly composed of an inner ring and an outer ring radially superposed on said inner ring; said outer ring being less rigid than said inner ring and being plastically deformable.

4. The spin-stabilized projectile as defined in claim 3, wherein said inner ring is a steel ring.

5. The spin-stabilized projectile as defined in claim 3, wherein a radial stiffness of said inner ring is selected such that upon firing of the projectile, said inner ring remains undeformed by radially inwardly directed pressures in the weapon barrel during deformation of said outer ring and yields to a gas pressure prevailing in said radial clearance.

6. The spin-stabilized projectile as defined in claim 3, wherein said outer ring, said rotational band and said projectile body have outer diameters; further wherein said outer diameter of said outer ring and said outer diameter of said rotational band are approximately identical; and further wherein said outer diameter of said inner ring is approximately 1 mm less than said outer diameter of said projectile body.

7. The spin-stabilized projectile as defined in claim 3, wherein said outer ring is of a synthetic material.

8. The spin-stabilized projectile as defined in claim 7, wherein said synthetic material is nylon.

9. The spin-stabilized projectile as defined in claim 7, where said synthetic material is PVC.

10. The spin-stabilized projectile as defined in claim 3, wherein said outer ring is of a soft metal.

11. The spin-stabilized projectile as defined in claim 10, wherein said soft metal is copper.

* * * * *